United States Patent [19]

Gall

[11] 4,212,495

[45] Jul. 15, 1980

[54] RECLINING CHAIR

[75] Inventor: John C. Gall, Chicago, Ill.

[73] Assignee: Sears, Roebuck & Co., Chicago, Ill.

[21] Appl. No.: 6,588

[22] Filed: Jan. 26, 1979

[51] Int. Cl.[2] ..... A47C 1/02

[52] U.S. Cl. ..... 297/84; 297/68; 297/317; 297/271

[58] Field of Search ..... 297/68, 271, 83, 84, 297/85, 89, 61, 317, 327; 5/20

[56] References Cited

U.S. PATENT DOCUMENTS

| | | | |
|---|---|---|---|
| Re. 28,210 | 10/1974 | Ré | 297/83 |
| Re. 29,483 | 11/1977 | Ré | 297/88 |
| 3,941,417 | 3/1976 | Ré | 297/85 |
| 809,944 | 1/1906 | Hanger . | |
| 1,507,613 | 9/1924 | Milky | 297/271 X |
| 1,754,703 | 4/1930 | Swindler | 297/271 X |
| 1,952,963 | 3/1934 | Batt | 297/271 |
| 1,984,281 | 12/1934 | Poggendorf . | |
| 2,634,796 | 4/1953 | Fischer . | |
| 3,572,829 | 3/1971 | Malitte . | |
| 3,801,122 | 4/1974 | Shoemaker et al. . | |
| 4,061,397 | 12/1977 | Lewis | 297/68 X |

*Primary Examiner*—James T. McCall

*Attorney, Agent, or Firm*—Arnstein, Gluck, Weitzenfeld & Minow

[57] ABSTRACT

A reclining chair adapted to be positioned in close adjacency to a wall, the chair having a frame and a body supporting unit which is movable relative to the frame between an upright sitting position and a variety of reclining positions. The frame is supported on ground engaging rollers and on rocker feet, the latter being connected by linkage arrangements to the body support unit. When the occupant moves the body supporting unit to reclining position both the chair frame and body supporting unit are caused to be moved away from the wall so that no part of the chair is in physical contact with the wall. Substantially 40% of the movement away from or toward the wall is effected by the body supporting unit and substantially 60% of the movement is effected by the frame. Upon movement to upright position the chair frame and body supporting unit return to the original position in close adjacency to the wall.

11 Claims, 11 Drawing Figures

SITTING POSITION

INTERMEDIATE POSITION

RECLINING POSITION

SITTING POSITION

RECLINING POSITION

RECLINING CHAIR

SUMMARY OF THE INVENTION

This invention relates to a reclining chair having a frame carrying a body supporting unit which is movable between an upright sitting position and a variety of reclining positions. The frame is adapted to move concurrently with the body supporting unit so that when the latter is in upright sitting position the frame may be positioned closely adjacent to a room wall. When the body supporting unit is moved to a reclining position the frame is caused to move away from the wall so that no part of the body supporting unit is in physical contact with the wall. The frame is supported at the front end on a pair of wheels, and at the rear end on a pair of pivotally mounted rocker feet. The rocker feet are interconnected with the body supporting unit so that the movement of the frame on the rocker feet will effect conjoint movement of the body supporting unit and vice versa. Thus, with an occupant sitting in upright position the chair may be positioned closely adjacent the wall and when the occupant moves the body supporting unit to reclining position the frame is caused to move away from the wall sufficiently so that the body supporting unit is not in physical contact with the wall.

BRIEF DESCRIPTION OF PREFERRED EMBODIMENT

The structure hereinafter to be described constitutes one side of the chair, with the other side being the mirror image.

Figure 1:
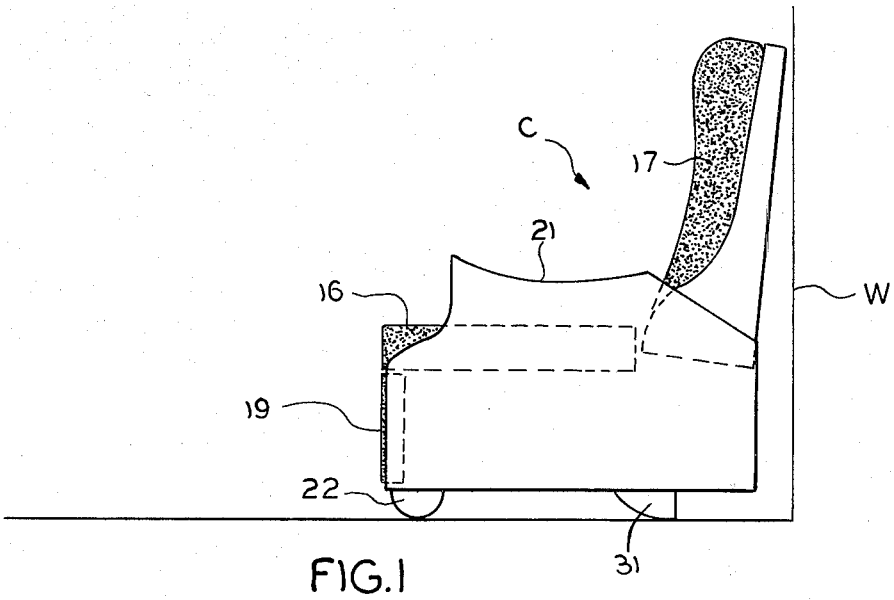
FIGS. 1-3 are schematic representations of a chair embodying the invention and showing the positions of the several chair components relative to a wall as the chair is moved from an upright sitting position to an intermediate or TV reclining position and then to a fully reclined position.
Figure 2:
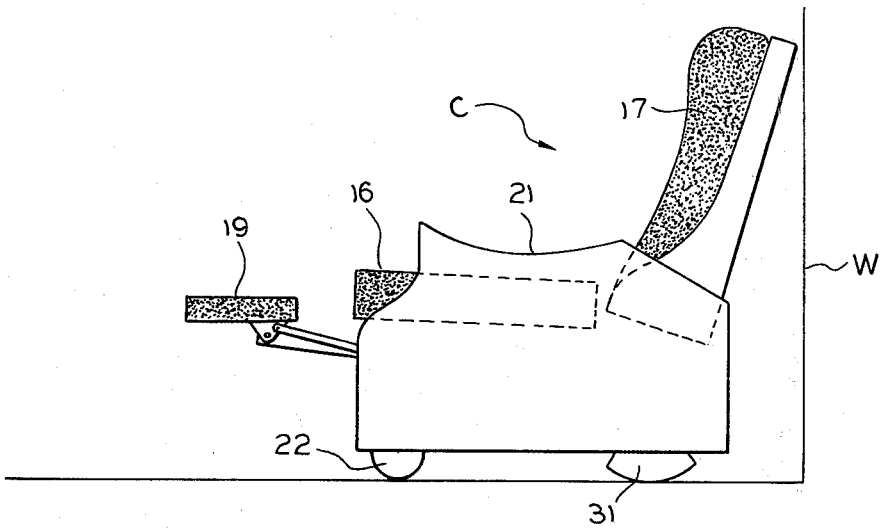
Figure 3:
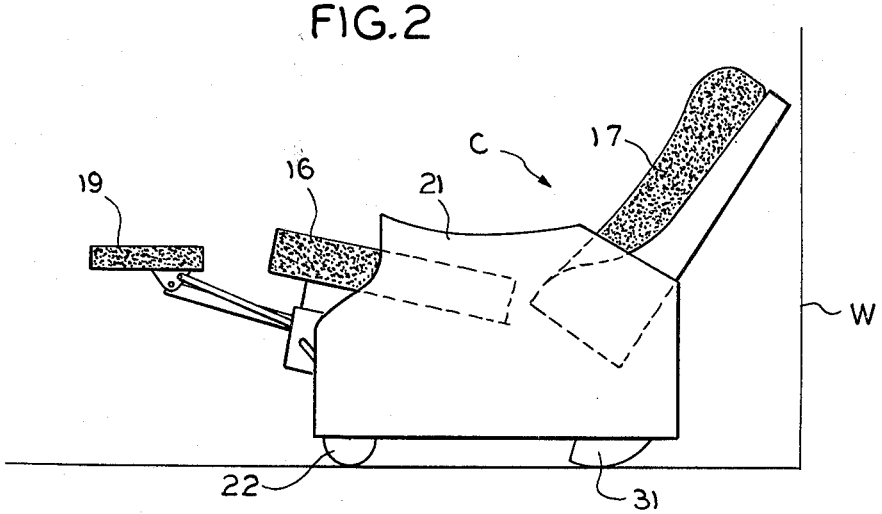

As seen in FIGS. 1-3, the chair C is adapted to be positioned in close relationship to a wall W, or other object, with the chair frame moving away from the wall to provide necessary clearance for the body supporting unit as the latter is moved between upright sitting position, intermediate or TV position and fully reclined position.

The chair C generally comprises a body supporting unit 15 (FIG. 4) including a seat and a back rest 17 pivotally related to each other and to a frame 18 which is movable relative to a supporting floor surface, and a leg rest 19 which is movable between retracted and extended positions concurrently jointly with the movement of the body supporting unit 15. The frame 18 includes side frame members 21 connected by cross members (not shown) at the front and rear ends, respectively. Secured to the front end of each side frame member 21 is a floor engaging roller means 22 which supports the front end of the chair. A pair of front and rear pins 23 and 24, respectively, carrying rollers are anchored in the side wall member 21 and extend inwardly to support the body supporting unit 15, presently to be described.

The body supporting unit 15 includes a pair of control members 26, each adjacent a respective side frame member 21. The members 26 are shaped substantially as illustrated, and may be formed of wood, sheet metal or molded plastic. Each member 26 includes an elongated guide channel or slot 27 extending longitudinally for the greater part of its length, a forward cam slot 28 comprising two leg portions and a rearward cam slot 29 inclined upwardly. It will be noted that both cam slots 28 and 29 are generally inclined upwardly, in opposite directions, and that the pins 23 and 24 are received in respective slots. Thus, the control member 26 may move forwardly and rearwardly relative to the side frame member 21, the direction of movement being determined by the direction of the respective cam slots 28 and 29.

Rockably supported on the rear pin 24 is a rocker foot 31 having a curved floor engaging tread 32 and provided with a pair of arms 33 and 34 which are rigidly connected to the rocker foot 31 and with each other and extend in angular relation to each other. One end of arm 33 is pivotally connected to a first drive link 36 which is pivotally connected to an upstanding extension 37 of the control member 26. Also, pivotally connected to extension 37 is a back link 38 which is pivotally connected as at 39 to the lower end of the back rest 17. An abutment member 41 is fixed to the back rest 17 and is adapted to be engaged along one side by the link 38 to limit the rearward movement of the back rest or provide releasable securement thereof, in other words, to maintain the back rest 17 in fixed relation to link 38 when the chair is in use. A second drive link 40 connects the upper end of the arm 34 to the upper end of the back link 38 completing a linkage subassembly, the operation of which will be hereinafter described.

Received in the slot or guide channel 27 of the control member 26 is an elongated foot rest slide bar 42, linearly movable which carries at its forward end a pair of pivotally supported brackets 43 on which are carried the foot rest 19. Pivotally secured to the control member 26, as at 44, is a generally V-shaped control link 46 which comprises two rigid arms **46*a*, 46*b* defining therebetween a V-shaped recess 47. One of the arms 46*a* is longer than the other arm 46*b* and is pivotally connected, as at 45, to a slide bar link 48 which is pivotally connected to the slide bar 42. A foot rest elevator link 49 is connected, at one end, to the upper end of the longer arm 46*a* of the control member at a point spaced inwardly from the connection 45 and, is connected, at the other end, to the bracket 43 at a point eccentric to the pivotal axis of the bracket. The linkage constitutes a toggle arrangement such that longitudinal movement of the elevator link 49 will effect rocking of the foot rest 19**, as will be hereinafter described.

The control link 46 includes a cam slot 51 having two legs and disposed below the pivotal axis 44, with the slot 51 opening downwardly. A pintle 52 fixed in the side wall of the side frame member 21 extends inwardly and is adapted to engage in the cam slot 51 in a manner, as will be hereinafter explained.

OPERATION

Figure 4:
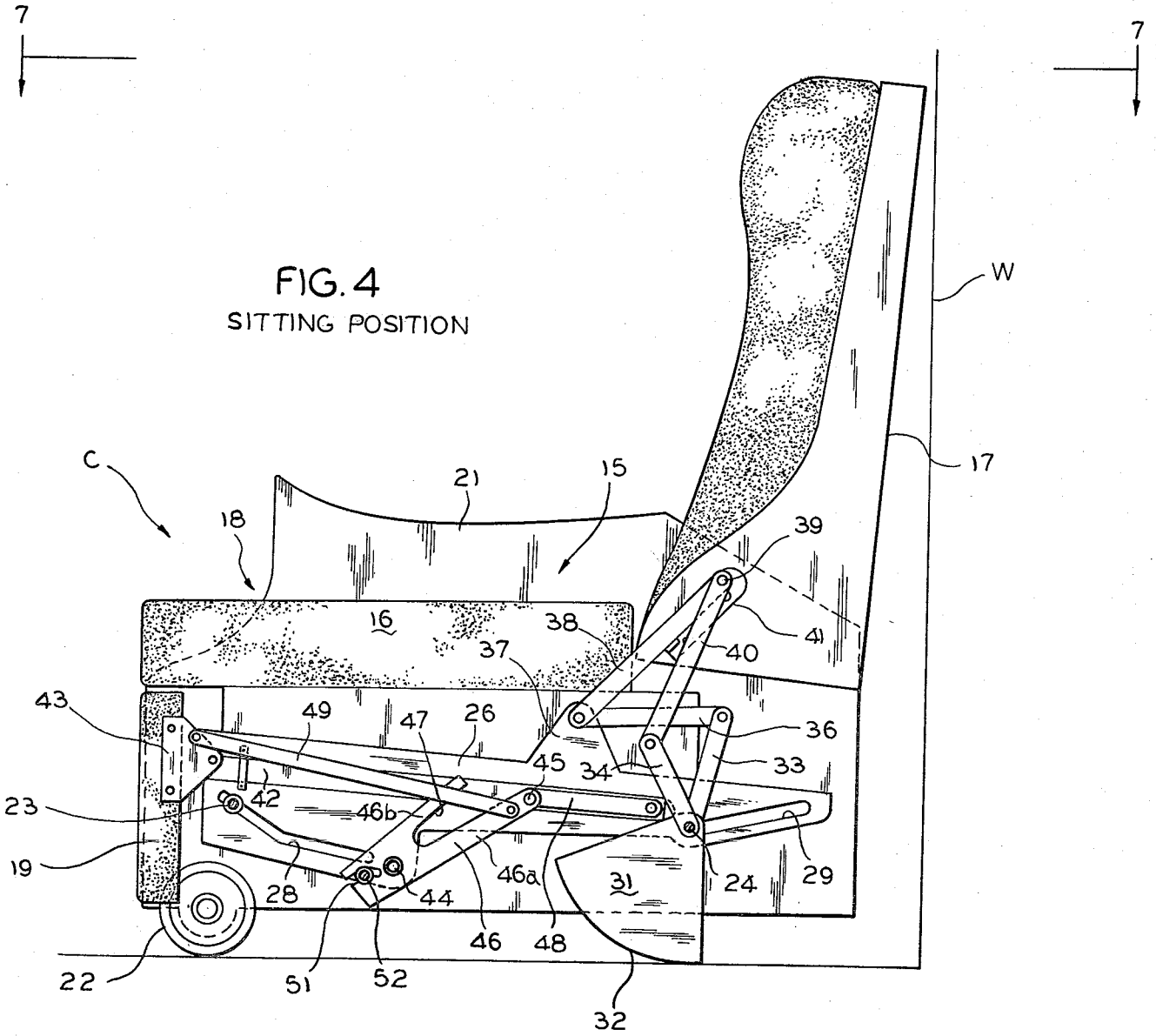
FIG. 4 is a fragmentary view, in longitudinal section, showing the chair in the upright sitting position, shown in FIG. 1.

Referring to FIG. 4 which illustrates the relationship of the components when the chair is in upright sitting position, it will be seen that the leg rest 19 is retracted, the back rest 17 is upright and the chair is supported at the front on the roller means 22 and, at the rear, only on the rear tread portions of the rocker feet 31 which engage the floor. It will be noted that the forward and rearward pins 23 and 24, respectively, engage the extreme right hand ends of the forward and rearward cam slots 28 and 29, respectively. Also, the pintle 52 is within the third cam slot 51 and is disposed substantially at the juncture of the legs of the slot.

Figure 5:
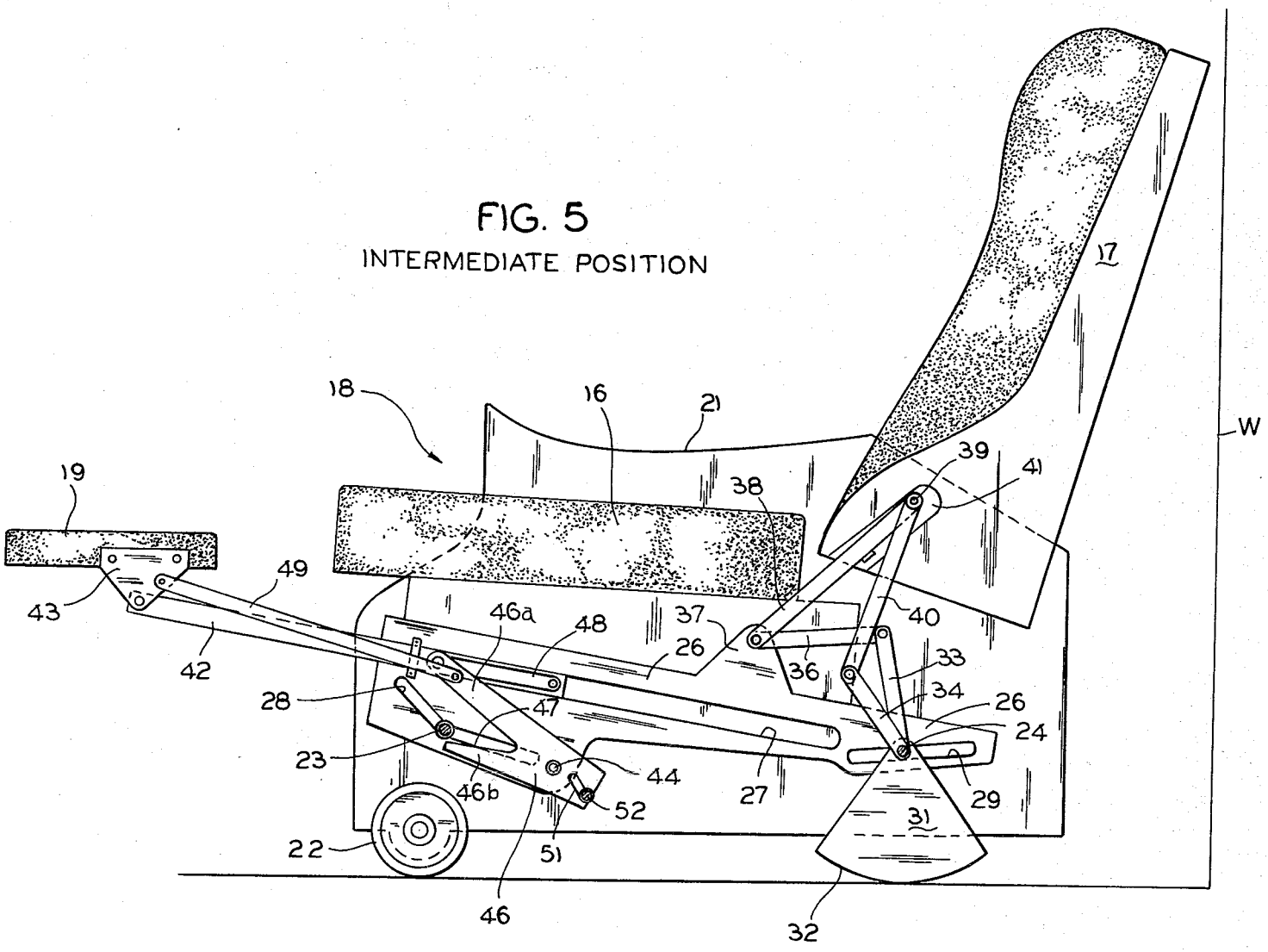
FIG. 5 is a view similar to FIG. 4 showing the chair in the partially reclined position, shown in FIG. 2.

The above described sitting position will be maintained until the occupant desires to move the chair to an intermediate TV or fully reclined position. In moving to the intermediate TV position, the occupant need only exert a rearward pressure on the back rest 17 with a concomitant forward reaction pressure on the seat 16 and side frame members 21 whereupon the seat 16 and control member 26 shift forwardly relative to the frame members 21 while the back rest 17 is caused to rock rearwardly, in a clockwise direction, to a partially reclined position. It will be noted that the control member 26 has rocked counterclockwise, as viewed in FIG. 5, so that the pin 24 is now disposed a short distance to the right of the left hand end of the cam slot 29 and also the rocker foot 31 has moved angularly counterclockwise about the axis of pin 24, thereby effecting movement of the chair C away from the wall surface W to accommodate the added inclination of the back rest 17 and provide clearance between the back rest and the wall.

Concomitantly, the forward ends of the seat 16 and control member 26 are caused to tilt upwardly by reason of the cam slot 28 acting on the pin 23. As the control member 26 moves to the left, as viewed in FIG. 5, the control link 46 carried thereon is similarly moved and is caused to be rocked counterclockwise so that the pintle 52 moves outwardly of the cam slot 51, to the point where the pintle 52 engages an edge of the mouth of the cam slot 51.

In this position pin 23 is disposed at the juncture of the leg portions of cam slot 28 and the control link 46 has been rocked to the point where the end of leg **46*b* of the control link is disposed just below and clear of pin 23. As the control link rocks about pivot 44, in a counterclockwise direction, the slide bar link 48 draws the slide bar 42 to the left and extends the foot rest 19. Concurrently, the foot rest 19 is rocked upwardly by the foot rest elevator link 49 to assume the position illustrated in FIG. 5, which corresponds to the intermediate TV position of the chair. The combined effect of the pin 23 being engaged in a detent at the juncture of the leg portions of slot 28 and the engagement of the edge of slot 51 with pin 52** maintains the chair in the TV position until the occupant desires to effect a change to other positions, as will be hereinafter described.

Figure 6:
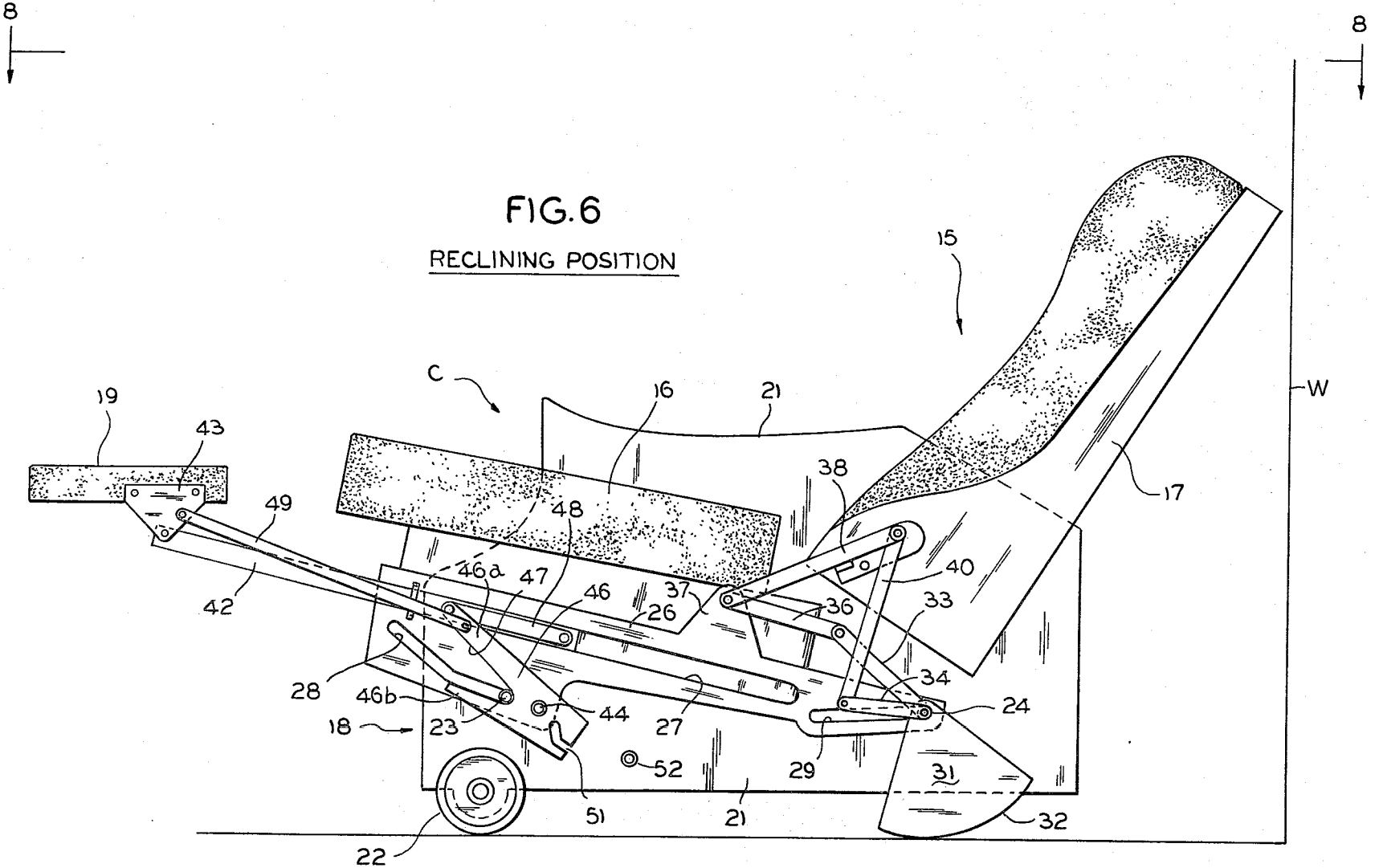
FIG. 6 is a view similar to FIG. 4 showing the chair in the fully reclined position, shown in FIG. 3.
Figure 7:
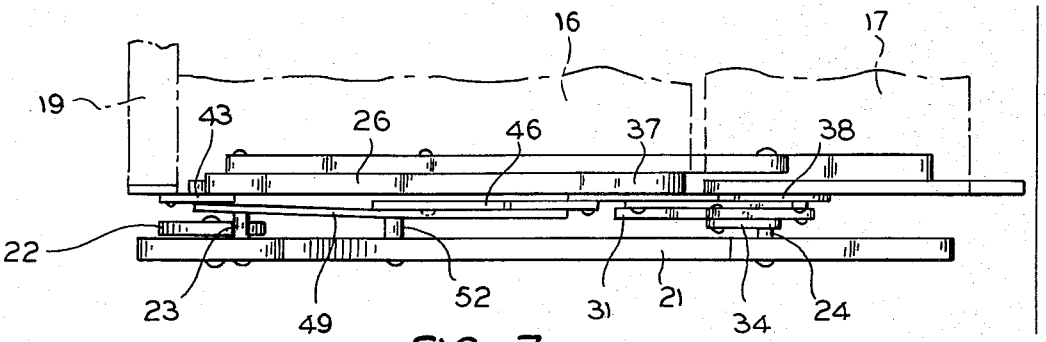
FIG. 7 is a top plan view of a portion of the mechanism in sitting position with parts omitted for clarity.
Figure 8:
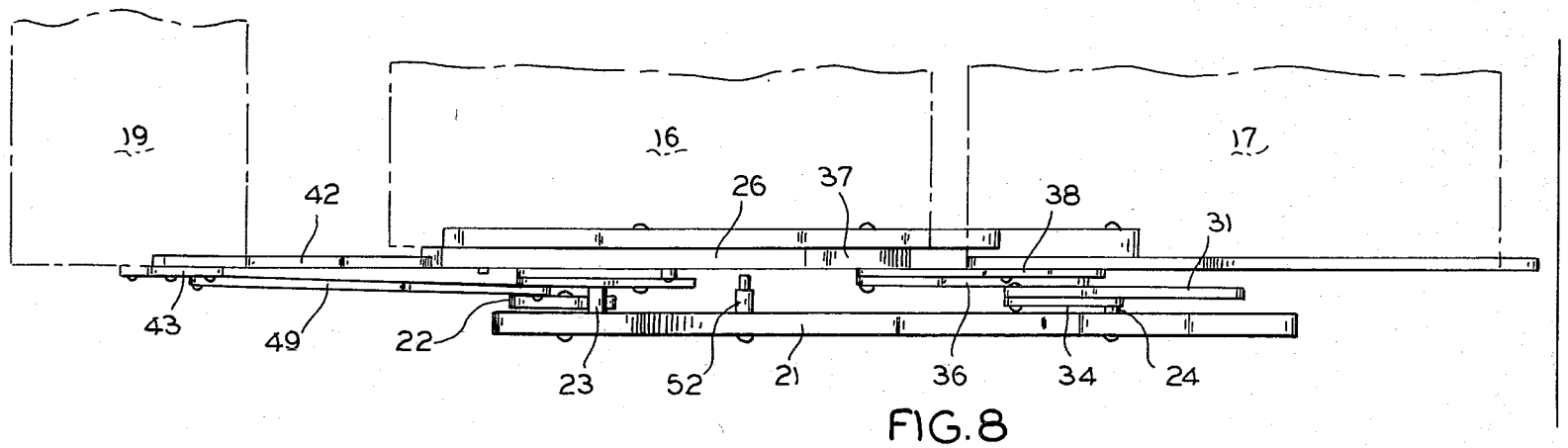
FIG. 8 is a view similar to FIG. 7 showing a portion of the mechanism in fully reclined position.
Figure 9:
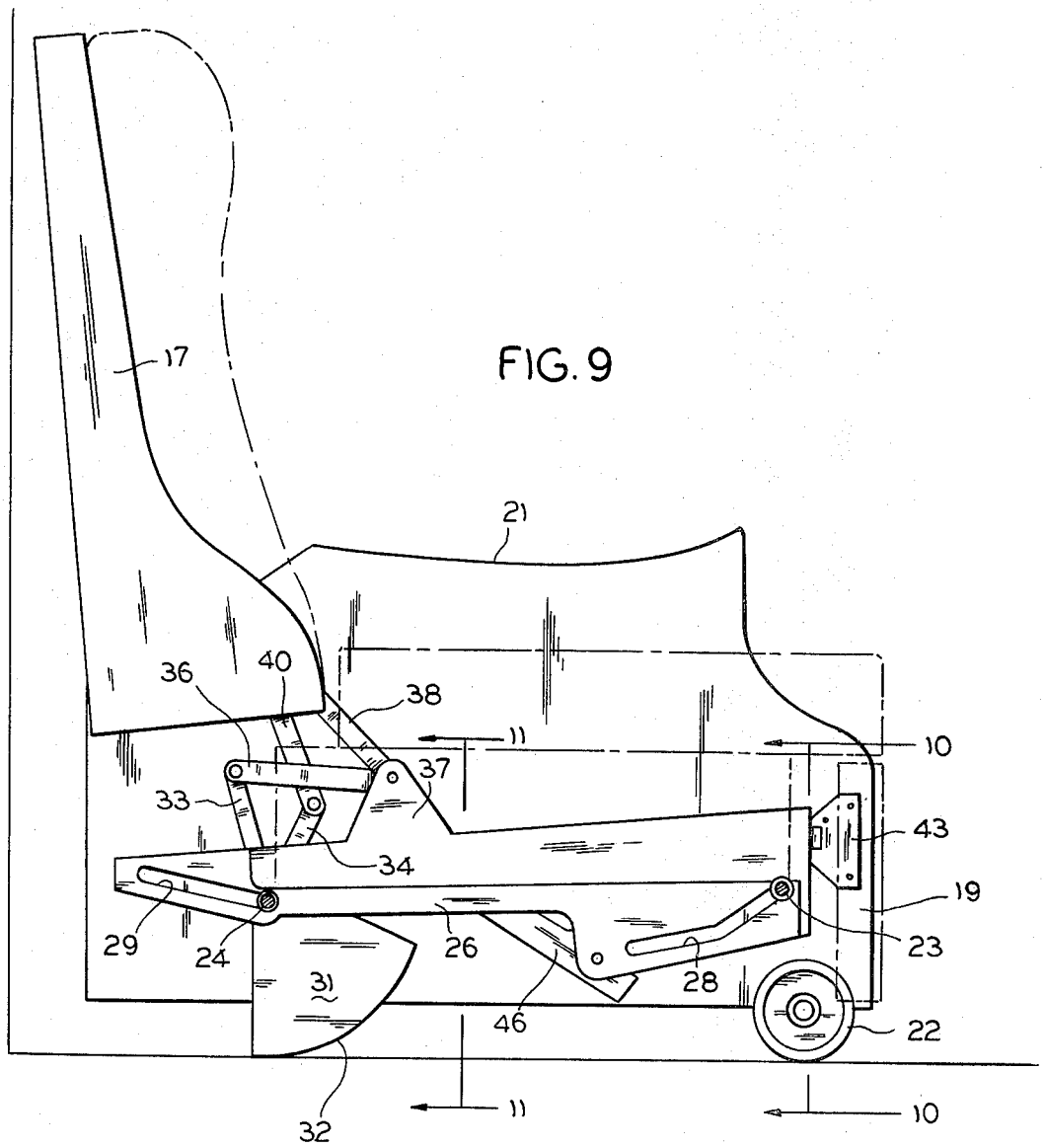
FIG. 9 is a view similar to FIG. 5 but looking from an opposite side.
Figure 11:
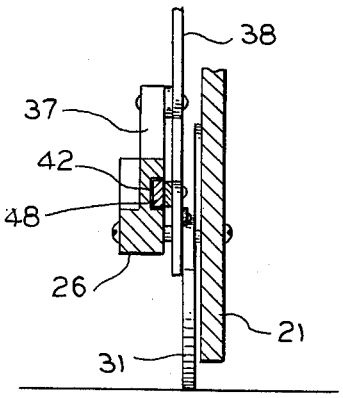
FIG. 11 is a cross-sectional view taken substantially on line 11—11 of FIG. 9.
Figure 10:
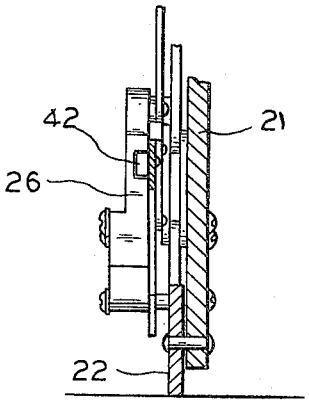
FIG. 10 is a cross-sectional view taken substantially on line 10—10 of FIG. 9.

In order to assume a fully reclined position, the occupant exerts further rearward pressure on the back rest 17 and forward pressure on the top of frame members 21 which effects further movement of the control member 26 and seat 16 to the left, as viewed in FIG. 6. It will be noted that in fully reclined position the pin 23 now is at the right hand end of the cam slot 28 and that the rocker foot 31 has moved an additional angular increment, thereby moving the chair farther away from the wall W to provide additional clearance between the wall and the back rest 17. As the control member 46 moves to the intermediate TV position of FIG. 5 to the fully reclined position of FIG. 6, the cam slot 51 acting on the pintle 52 has effected counterclockwise rotation of the control link 46, to the point where the inner edge of the shorter arm **46*b* of the control link 46 is substantially in registration with the bottom edge of the lower leg portion of the cam slot 28. Thus, pin 23 may move into said lower leg slot portion without obstruction, to the point where it engages the bottom of the V-shaped recess 47 in the control link 46. Also, the control link 46 has been moved away from the pintle 52. It is noted, in the relationship illustrated in FIG. 6, that the foot rest elevator link 49, control link 46 and slide bar link 48, in effect, constitute a toggle arrangement which effectively locks the foot rest 19** in fully extended position, which position will be maintained against inadvertent dislodgement until deliberately changed by the occupant.

To return the chair from fully reclined position (FIG. 6) to the intermediate TV position (FIG. 5) or upright sitting position (FIG. 4), the occupant need only lean slightly forward to remove any rearward pressure on the back rest 17 and exert a similar rearward pressure on the frame members 21 with his hands. This action effects substantially linear concurrent movement, to the right, as viewed in FIG. 6, of the foot rest 19, control member 26, control link 46, foot elevator link 49 and slide bar 42 to the point where the cam slot 51 begins to engage the pintle 52. At this point the pin 23 is disposed at the juncture of the leg portions of cam slot 28 and is clear of the shorter leg **46*b*. Concomitantly the control member 26, in its movement, has effected some angular movement of the rocker foot 31 in a clockwise direction, as viewed in FIG. 6, to move the chair a short distance in the direction of the wall. As the pintle 52 moves farther into cam slot 51, the control link 46 is caused to be rocked clockwise, thereby releasing the locking effect of the toggle joint, so that continued rearward pressure will permit the parts first to assume the intermediate TV position shown in FIG. 5 and finally, the fully retracted or upright sitting position shown in FIG. 4. Concomitantly, the rocker foot 32** is caused to move angularly in a clockwise direction to move the chair closer to the wall.

It will be apparent from the foregoing that the movement of the chair away from the wall is due in part to the movement of the frame and in part to the movement of the body supporting unit relative to the frame. Thus, the relationship of the seat to the frame is such that the side arm members of the frame and particularly the front edges of the arm members always are within convenient reach of the occupant. In returning from TV or fully reclined positions an occupant may comfortably grasp the front edges of the arm members to urge his body forwardly so as to remove pressure from the back rest. In the present invention because of the provision of the compound movement, namely that of the chair frame relative to the wall and that of the body supporting unit relative to the frame, the linkage required to provide the necessary multiplication for extending the foot rest may be substantially more simple in construction than prior art devices. This results in a load reduction on the bearings and extends their service life.

Various changes coming within the spirit of my invention may suggest themselves to those skilled in the art; hence, I do not wish to be limited to the specific embodiments shown, and described or uses mentioned, but intend the same to be merely exemplary, the scope of my invention being limited only by the appedned claims.

I claim:

1. A reclining chair adapted to be positioned in close adjacency to a room wall when in upright sitting position and automatically movable away from the wall upon the assumption of a reclined position to avoid physical contact with the same wall, the reclining chair comprising a base frame having a pair of side frame members and supported at its front end on a pair of rotatable floor engaging rollers and at its rear end on a pair of rotatable floor engaging rocker feet, a body supporting unit including a pair of control members each in juxtaposition to a respective side member and a seat and back rest having pivotal relationship with each other, each said control member having forward and rearward cam slots, each side frame member having forward and rearward pins received respectively in said forward and rearward cam slots and mounting the body supporting unit for movement relative to the frame between upright and reclining positions, a leg supporting unit, means for mounting the leg supporting unit relative to the body supporting unit in movements between retracted and extended positions as the body supporting unit is concomitantly moved, and means operatively connecting the body supporting unit and the rocker feet for rocking the rocker feet in one direction to move the frame forwardly away from the wall as transition is made from upright sitting position toward a position of reclination and for rocking the rocker feet in a reverse direction to move the frame rearwardly toward the wall as transition is made from a reclined position toward upright position.

2. A reclining chair adapted to be positioned in close adjacency to a room wall when in upright sitting position and automatically movable away from the wall upon the assumption of a reclined position to avoid physical contact with the same wall, the reclining chair comprising a base frame having a pair of side frame members and supported at its front end on a pair of rotatable floor engaging rollers and at its rear end on a pair of rotatable floor engaging rocker feet, a body supporting unit including a pair of control members each in juxtaposition to a respective side member, a seat fixed on said pair of control members and a back rest having pivotal relationship with said seat, each said control member having forward and rearward cam slots, each side frame member having forward and rearward pins received respectively in said forward and rearward cam slots and mounting the control members for movement relative to the frame between upright and reclining positions, a leg supporting unit, means for mounting the leg supporting unit relative to the body supporting unit in movements between retracted and extended positions as the body supporting unit is concomitantly moved, and means operatively connecting the body supporting unit and the rocker feet for rocking the rocker feet in one direction to move the frame forwardly away from the wall as transition is made from upright sitting position toward a position of reclination and for rocking the rocker feet in a reverse direction to move the frame rearwardly toward the wall as transition is made from a reclined position to upright position.

3. An occupant operated reclining chair adapted to be positioned in close adjacency to a room wall when in an upright position and automatically movable away from the wall upon the assumption by the operator of a reclined position to avoid physical contact of the chair with the same wall, the reclining chair comprising a base frame having a pair of side frame members and supported at its front end on a pair of rotatable floor engaging rollers and at its rear end on a pair of rotatable floor engaging rocker feet, a body supporting unit including a pair of control members each in juxtaposition to a respective side member, a seat fixed on said pair of control members and a back rest having pivotal relationship with said seat, each said control member having forward and rearward cam slots, each side frame member having forward and rearward pins received respectively in said forward and rearward cam slots and mounting the body supporting unit for movement relative to the frame between upright and reclining positions, and means operatively connecting the body supporting unit and the rocker feet for rocking the rocker feet in one direction to move the frame forwardly away from the wall as transition is made from upright sitting position toward a position of reclination and for rocking the feet in a reverse direction to move the frame rearwardly toward the wall as transition is made from a reclined position toward upright position.

4. The invention as defined in claim 1 in which the rotational axis of said rocker feet is coincident with the axis of said rear pins.

5. The invention as defined in claim 3 including linkage mechanism operatively interconnecting the control members, the rocker feet and the back rest and operative when rearward pressure is applied by the occupant on the back rest to move the control members forwardly relative to the frame and concurrently to rotate the rocker feet to move the chair forwardly away from the wall.

6. An occupant operated reclining chair adapted to be positioned in close adjacency to a room wall when in an upright position and automatically movable away from the wall upon the assumption by the operator of a reclined position to avoid physical contact of the chair with the same wall, the reclining chair comprising a base frame having a pair of side frame members and supported at its front end on a pair of rotatable floor engaging rollers and at its rear end on a pair of rotatable floor engaging rocker feet, a body supporting unit including a pair of control members each in juxtaposition to a respective side member, a seat fixed on said pair of control members and a back rest having pivotal relationship with said seat, each said control members having forward and rearward cam slots, a leg supporting unit, means for mounting the leg supporting unit relative to the control members in movements between retracted and extended positions as the control members are concomitantly moved, linkage mechanisms operatively interconnecting the control members, the back rest, the rocker feet, the leg rest and frame, and operative for first concurrently moving (a) the back rest rearwardly relative to the frame, (b) the control members and seat forwardly relative to the frame, (c) the leg rest between retracted and extended positions, and (d) the rocker feet relative to the frame to move the frame forwardly away from the wall, as transition is made from upright sitting position by the occupant applying pressure against the back rest and exerting a forwardly pushing force against the side members, and for, secondly, concurrently moving (a) the back rest forwardly relative to the frame, (b) the control members and seat rearwardly relative to the frame, (c) the leg rest between retracted and extended positions, and (d) the rocker feet relative to the frame to move the frame rearwardly towards the wall, as transition is made from a reclining position to upright sitting position by the occupant leaning forwardly away from the back and exerting a rearwardly pushing force on the leg rest.

7. The invention as defined in claim 1, in which each control member includes a longitudinally extending guide channel and a slide bar received in said channel for linear movement with said slide bar being pivotally connected to said leg supporting unit.

8. The invention as defined in claim 7 including linkage mechanism operative to move said slide bar to extended position as transition is made from upright sitting position toward a position of reclination and to move said slide bar to retracted position as transition is made from a reclined position to upright position.

9. The invention as defined in claim 8 including a control link pivotally supported on each control member and operatively connected to said slide bar and to said leg supporting unit, said control link being rockable about its pivotal axis in response to linear movement of said slide bar to dispose the leg supporting unit when in extended position in a substantially horizontal mode and to dispose the leg supporting unit when in retracted position in a substantially vertical mode.

10. A reclining chair adapted to be positioned in close adjacency to a room wall when in upright sitting position and automatically movable away from the wall upon the assumption of a reclined position to avoid physical contact with the same wall, the reclining chair comprising a base frame having a pair of side frame members and supported at its front end on a pair of rotatable floor engaging rollers and at its rear end on a pair of rotatable floor engaging rocker feet, a body supporting unit including a seat and back rest having pivotal relationship with each other, means for mounting the body supporting unit for movement relative to the frame between upright and reclining positions, and means operatively connecting the body supporting unit and the rocker feet for rocking the rocker feet in one direction to move the frame forwardly away from the wall as transition is made from upright sitting position toward a position of reclination and for rocking the rocker feet in a reverse direction to move the frame rearwardly toward the wall as transition is made from a reclined position toward upright position.

11. A reclining chair adapted to be positioned in close adjacency to a room wall when in upright sitting position and automatically movable away from the wall upon the assumption of a reclined position to avoid physical contact with the same wall, the reclining chair comprising a base frame having a pair of side frame members and supported at its front end on a pair of rotatable floor engaging rollers and at its rear end on a pair of rotatable floor engaging rocker feet, a body supporting unit including a seat and back rest having pivotal relationship with each other, means for mounting the body supporting unit for movement relative to the frame between upright and reclining positions, a leg supporting unit, means for mounting the leg supporting unit relative to the body supporting unit in movements between retracted and extended positions as the body supporting unit is concomitantly moved, and means operatively connecting the body supporting unit and the rocker feet for rocking the rocker feet in one direction to move the frame forwardly away from the wall as transition is made from upright sitting position toward a position of reclination and for rocking the rocker feet in a reverse direction to move the frame rearwardly toward the wall as transition is made from a reclined position toward upright position.

* * * * *